US008098858B2

(12) United States Patent
Gebhardt et al.

(10) Patent No.: US 8,098,858 B2
(45) Date of Patent: Jan. 17, 2012

(54) HEARING DEVICE WITH CURRENT-CONDUCTING METAL ARM

(75) Inventors: Volker Gebhardt, Neunkirchen am Brand (DE); Peter Nikles, Erlangen (DE); Erika Radick, Nürnberg (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 1127 days.

(21) Appl. No.: 11/974,883

(22) Filed: Oct. 16, 2007

(65) Prior Publication Data

US 2008/0232624 A1 Sep. 25, 2008

Related U.S. Application Data

(60) Provisional application No. 60/852,122, filed on Oct. 16, 2006.

(51) Int. Cl.
*H04R 25/00* (2006.01)

(52) U.S. Cl. ..... 381/315; 381/323

(58) Field of Classification Search ..... 381/322, 381/323, 312, 315, 324, 327, 328, 330, 331
See application file for complete search history.

(56) References Cited

U.S. PATENT DOCUMENTS

| | | | |
|---|---|---|---|
| 5,020,136 | A | 5/1991 | Patsiokas et al. |
| 2005/0232454 | A1 | 10/2005 | Niederdrank et al. |
| 2005/0244024 | A1 | 11/2005 | Fischer et al. |
| 2006/0093174 | A1 | 5/2006 | Niederdrank et al. |

FOREIGN PATENT DOCUMENTS

| | | | |
|---|---|---|---|
| DE | 10 2004 051 226 | B3 | 1/2006 |
| EP | 1583395 | A2 | 10/2005 |
| EP | 1587343 | A2 | 10/2005 |
| WO | WO 2005/081583 | A1 | 9/2005 |

*Primary Examiner* — Elvin G Enad
*Assistant Examiner* — Andrew R Millikin

(57) ABSTRACT

The influence of interference from power supply lines in hearing devices is to be reduced. Thus a hearing device with an antenna for receiving and/or sending inductive signals, a signal processing device, to which the antenna is connected, a power supply unit for supplying power to the signal processing device and an electrical conductor for electrical connection of the power supply unit to the signal processing device is provided. The electrical conductor is L-shaped or U-shaped and closely follows the contours of the power supply unit. In addition the electrical conductor forms a part of an essentially round or rectangular ring, the axis of which has a main directional component perpendicular to the longitudinal axis of the antenna. A magnetic field created by the conductor is thus perpendicular to the antenna, so that its magnetic interference influence is reduced.

8 Claims, 1 Drawing Sheet

HEARING DEVICE WITH CURRENT-CONDUCTING METAL ARM

CROSS REFERENCE TO RELATED APPLICATIONS

The present application claims the benefit of the provisional patent application filed on Oct. 16, 2006, and assigned application number 60/852,122, and is incorporated by reference herein in its entirety.

FIELD OF THE INVENTION

The present invention relates to a hearing aid with an antenna for receiving and/or sending inductive signals, a signal processing device to which the antenna is connected, a power supply unit for supplying power to the signal processing device and an electrical conductor for electrical connection of the power supply unit to the signal processing device. The term "antenna" is also especially also understood here as coil parts and coils.

BACKGROUND OF THE INVENTION

Hearing devices are wearable hearing apparatus used to assist the hard-of-hearing. To meet the numerous individual requirements different designs of hearing device are provided, such as behind-the ear (BTE) hearing devices, in-the-ear (ITE) hearing devices and Concha hearing devices. The typical configurations of hearing device are worn on the outer ear or in the auditory canal. Above and beyond these designs however there are also bone conduction hearing aids, implantable or vibro-tactile hearing aids available on the market. In such hearing aids the damaged hearing is simulated either mechanically or electrically.

Hearing devices principally have as their main components an input converter, an amplifier and an output converter. The input converter is as a rule a sound receiver, e.g. a microphone, and/or an electromagnetic receiver, e.g. an induction coil. The output converter is mostly implemented as an electroacoustic converter, e.g. a miniature loudspeaker or as an electromechanical converter, e.g. bone conduction earpiece. The amplifier is usually integrated into a signal processing unit. This basic structure is shown in FIG. 1 using a behind-the ear hearing device as an example. One or more microphones 2 for recording the sound from the surroundings are built into a hearing device housing 1 worn behind the ear. A signal processing unit 3, which is also integrated into the hearing device housing 1, processes the microphone signals and amplifies them. The output signal of the signal processing unit 3 is transmitted to a loudspeaker or earpiece 4 which outputs an acoustic signal. The sound is transmitted, if necessary via a sound tube which is fixed with an otoplastic in the auditory canal, to the hearing device wearer's eardrum. The power is supplied to the hearing device and especially to the signal processing unit 3 by a battery 5 also integrated into the bearing device housing 1.

When inductive transmission systems are used in hearing aid devices it is necessary to keep down the influence of internal faults, i.e. those generated in the hearing aid device itself. Electromagnetic interference signals which are created within the hearing aid device, impose a load on the receive path of the transmission system, so that only those external signals are received for which the signal strength is above the signal strength of the interference signals.

Typical sources of electromagnetic interference are for example the earpiece, which is embodied as a magnetic converter, or the hearing aid electronics, which itself emits electromagnetic interference signals. In addition all connecting lines between the components of the hearing aid device which, from the current flow through the lines, function as inductive antennas should be mentioned as sources of interference. The overlaying of these numerous electromagnetic interference signals emitted by the different interference sources will be received at the location of a receive antenna or of a receive coil of a wireless signal transmission system which uses the inductive range or the typical HF range.

Assuming that the local arrangement of all components in a hearing aid device is fixed line loops can be deliberately applied through which a current flows and which generate the corresponding opposing field at the location of the receive antenna. A corresponding hearing aid device with a line loop to compensate for inductive interference fields is known from patent application DE 10 2004 051 226 B3. In concrete terms it is proposed in this document to lay a line loop such that its axis runs in parallel to that of a send/receive coil. Compensation for inductive interference fields has the disadvantage however that the size of the interference fields must at least be known as regards their order of magnitude. A further disadvantage of this line laying arrangement lies in the fact that the line can be squashed, scraped or nicked when the hearing device is closed. In addition this line laying arrangement requires sufficient space, around the battery of the hearing device for example.

Different forms of antennas extending in one plane are described in WO 2005/081583 A1. The antennas are fitted in a hearing device so that as much of their surface area as possible touches a battery of the hearing device. In this way the battery shields the antenna from electromagnetic radiation which is emitted by other components of the hearing device, for example by the loudspeaker.

SUMMARY OF THE INVENTION

The object of the present invention consists of keeping the effect of interference fields in hearing devices low using simple means.

Inventively this object is achieved by a hearing device with an antenna for receiving and/or sending inductive signals, a signal processing device to which the antenna is connected, a power supply unit to supplying power to the signal processing device and an electrical conductor for electrical connection of the power supply unit to the signal processing device, with the electrical conductor being in an L-shape or U-shape closely following the contours of the power supply unit and the electrical conductor being a part of a round or rectangular ring of which the axis possesses a main directional component perpendicular to the longitudinal axis of the antenna. Advantageously the effect of an interference field of an electrical conductor through which current flows is minimized by it being aligned so that its interference field is oriented perpendicular to the sensitivity maximum of components of the hearing device sensitive to interference. The interferences between interference field and effective field thus minimized and not intentionally aimed for as with compensation.

The hearing device can be embodied as an in-the-ear hearing device with a faceplate, with the longitudinal axis of the antenna essentially being arranged perpendicular to the faceplate and an arm of the electrical conductor likewise being embodied essentially perpendicular to the faceplate. This arrangement frequently allows a saving in space to be achieved since there is the most space in the hearing device in the direction perpendicular to the faceplate as a rule.

Preferably the electrical conductor is essentially made of a metal strip. Compared to a round conductor with the same conductor cross section this can be arranged in a space-saving manner with the given alignment.

If the power supply unit has a cylindrical battery it is useful to have the electrical conductor running partly in the radial direction and partly in the axial direction of the battery. This enables a shorter electrical conductor to be implemented which runs around the battery.

In accordance with a special embodiment the electrical conductor can be welded to a battery contact. Alternatively the electrical conductor can also be a part of a battery contact. In the latter case a reduction in parts is advantageously produced.

The inventive embodiment and arrangement of the electrical conductor provides particular advantages in a hearing device of modular construction, with a signal processing component including the electrical conductor and the power supply unit being mounted on the face plate and forming a first module, while a hearing device shell with an earpiece forms a second module. Since with these types of modular hearing aid devices the receive coils are placed independently of the remaining hearing device electronics it is better not to be dependent on the quality of a compensation for interference fields but to keep the interferences as low as possible by the perpendicular arrangement right from the outset

BRIEF DESCRIPTION OF THE DRAWINGS

The present invention is explained in greater detail with reference to the enclosed drawings, which show.

DETAILED DESCRIPTION OF THE INVENTION

The exemplary embodiments described in greater detail below represent preferred embodiments of the present invention.

The invention is based on the knowledge that the spatial alignment of a receive coil moves within specific angular boundaries. This results from the fact that on the one hand the function of a radio transmission must be ensured and on the other hand the space available in the auditory canal is also physiognomically restricted. All lines in the hearing device or hearing aid device through which the electrical current flows act as inductive antennas which generate a magnetic interference field. The interference influence of the magnetic field on the receive antenna depends on the amplitude and the direction of the magnetic field in relation to the alignment of the receive antenna. Depending on the spatial alignment of the receive coil, lines can now be geometrically routed so that a coupling-in of the magnetic field into the receive antenna is minimized. The interference influence of the magnetic field on a receiver coil can be kept as small as possible by this measure not only locally but also in a larger spatial area.

To guarantee an optimum radio transmission in hearing devices as well, send and receive coils are to be arranged in parallel to each other. With in-the-ear hearing devices the antennas or coils are to be aligned within certain limits, imposed by the alignment of the auditory canal, thus perpendicular to the faceplate plane. If now, as is usually the case, leads are routed in in-the-ear hearing devices in the face pate plane, these lines form a current loop and create a magnetic field which is predominantly oriented in parallel to the receive antenna. This would result in a maximum interference field coupling-in.

Figure 1:
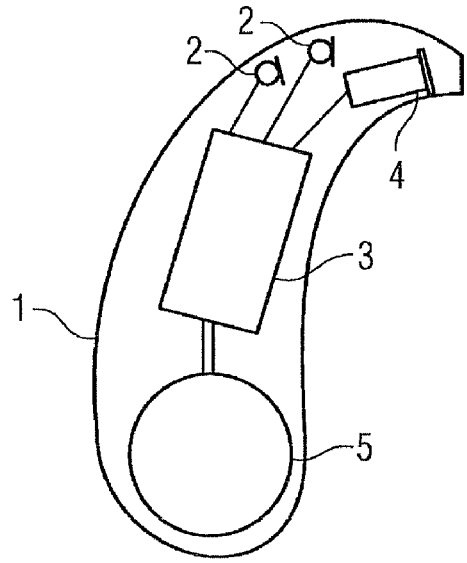
FIG 1 (Prior art)
FIG. 1 a basic diagram of a hearing device with its essential components and FIG. 2 the faceplate of an in-the-ear hearing device with inventively arranged electrical conductor.
Figure 2:
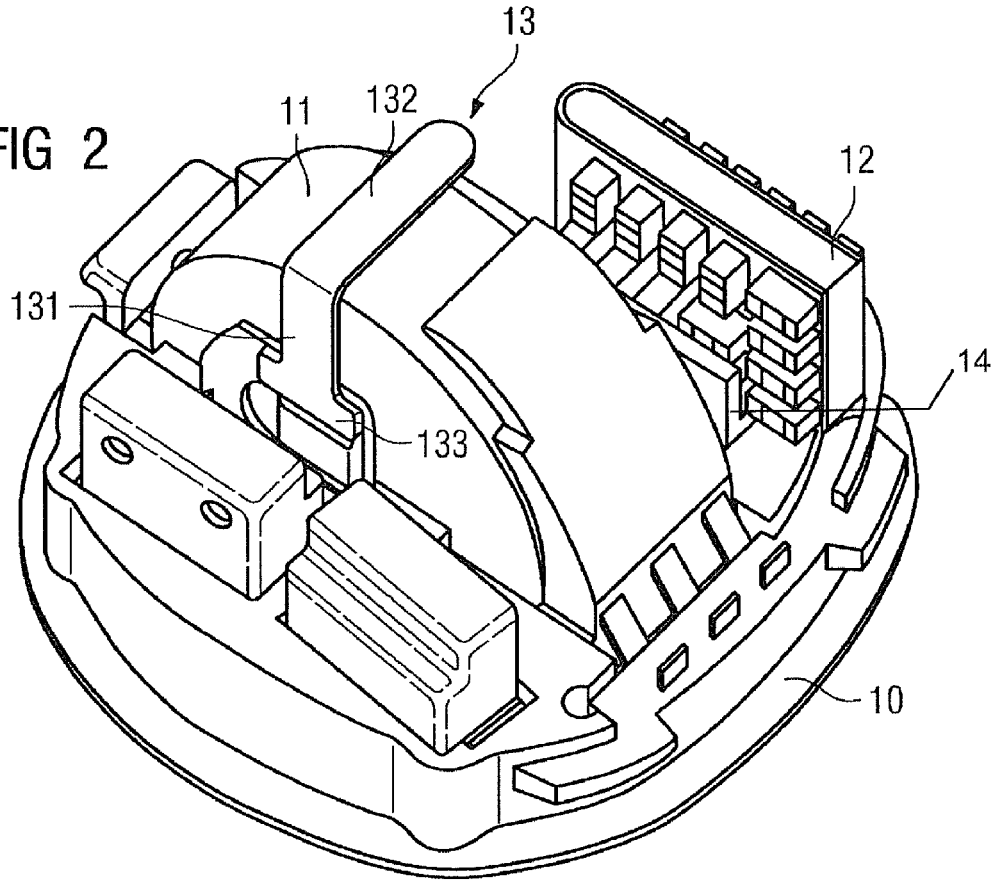

In accordance with the present invention however there is no provision for forming a current loop with the leads in parallel to the faceplate plane but, as is shown in FIG. 2, perpendicular to the faceplate plane.

In concrete terms FIG. 2 shows a faceplate 10 of which is equipped with a battery 11 and a circuit board 12. The axis of the battery 11 is located in parallel to the faceplate plane, i.e. the main extension plane of the faceplate 10. A metal arm is used to conduct the current from the battery 11 to the circuit board 12. It is embodied as a rigid part and consists of a band-shaped conductor material. It is not embodied insulated here since it does not touch any electronic components other than one pole of the battery 11.

In the selected example the metal arm is embodied as an L shape. One of its limbs 131 extends from the axis of the battery in a radial direction of the battery and is perpendicular to the faceplate plane. The other limb 132 of the metal arm 13 extends on the outer surface of the battery 11 along its axial direction. At its free end the first limb 131 is connected as one piece to a battery contact 133 and is held in a special section of the faceplate 10. The second limb 132 is connected at its free end to the circuit board 12, which cannot be seen from FIG. 2. The metal arm 13 thus forms a part of an essentially rectangular ring of which the axis runs in parallel to the faceplate plane. Alternating current components in this metal arm 13 thus lead to a magnetic field with a main component in parallel to the faceplate plane.

Since a receive antenna 14, as mentioned above, is as a rule arranged almost perpendicular to the faceplate 10, i.e. its main directional component is perpendicular to the faceplate plane, the magnetic interference field caused by the metal arm 13 is essentially perpendicular to the receive antenna 14. The effect of the interference field is minimized by this.

Since the metal arm involves a stable component and this is welded to the battery contact or to a part of the battery contact 133 itself, the constructional tolerance compared to laying loose wire lines is reduced. For the construction of so-called "semi-modular" in-the-ear hearing devices in which, as mentioned, the faceplate with the signal processing electronics forms a first module and the shell with the earpiece forms a second module and in which the receiver coil is placed independently of the remaining hearing device electronics, the clearly-defined position of the metal arm is essential for a function of the transmission system.

Given the technical requirement that the alignment of the receive antenna must be kept within specific limits, the location of the receive coil within the hearing device can be varied since the interference influence has been minimized by the invention over a larger spatial area. A system for constructing hearing devices in which the receive antenna is placed independently of the other components can be implemented in this way.

The expense of additional line loops which generally only generate an opposing field locally is also dispensed with by the inventive solution. Furthermore the greater freedom in relation to the spatial placing of the receive antenna makes it possible to construct smaller in-the-ear hearing aid devices.

The invention claimed is:

1. A hearing device, comprising:

an antenna;

a signal processing device connected to the antenna;

a power supply unit that supplies power to the signal processing device; and an electrical conductor that electrically connects the power supply unit to the signal processing device, wherein the electrical conductor is in a shape closely following contours of the power supply unit and forms a part of a ring of which an axis possesses a directional component perpendicular to a longitudinal axis of the antenna.

2. The hearing device as claimed in claim 1, wherein the electrical conductor is L-shaped or U-shaped and the ring is a round or rectangular ring.

3. The hearing device as claimed in claim 1, wherein the hearing device is an in-the-ear hearing device comprising a faceplate, and wherein the longitudinal axis of the antenna and an arm of the electrical conductor is perpendicular to the faceplate.

4. The hearing device as claimed in claim 1, wherein the electrical conductor is made from a metal strip.

5. The hearing device as claimed in claim 1, wherein the power supply unit comprises a cylindrical battery and the electrical conductor follows partly in a radial direction and partly in an axial direction of the cylindrical battery.

6. The hearing device as claimed in claim 1, wherein the electrical conductor is welded to a battery contact.

7. The hearing device as claimed in claim 1, wherein the electrical conductor is a part of a battery contact.

8. The hearing device as claimed in claim 1, wherein a first module of the hearing device comprises the signal processing device, the electrical conductor, and the power supply unit that are mounted on a faceplate of the hearing device, and wherein a second module of the hearing device comprises a shell and an earpiece of the hearing device.

* * * * *